US005711425A

United States Patent [19]

Trimble-Gomez

[11] Patent Number: 5,711,425

[45] Date of Patent: Jan. 27, 1998

[54] METHOD AND APPARATUS FOR INDICATING A DOSAGE OF MEDICINE

[76] Inventor: Patricia Louise Trimble-Gomez, 57 Cavendish Crescent, Brampton, Ontario, Canada, L6T 1Z3

[21] Appl. No.: 696,211

[22] Filed: Aug. 13, 1996

[51] Int. Cl.[6] ..... B65D 77/00

[52] U.S. Cl. ..... 206/570; 206/534

[58] Field of Search ..... 283/70; 40/306, 40/310, 311, 312, 633; 206/459.5, 528, 534, 570, 571

[56] References Cited

U.S. PATENT DOCUMENTS

| | | | |
|---|---|---|---|
| 4,783,917 | 11/1988 | Smith et al. . | |
| 4,833,807 | 5/1989 | McLean . | |
| 4,863,195 | 9/1989 | Capozzola . | |
| 4,914,843 | 4/1990 | DeWoskin . | |
| 4,984,683 | 1/1991 | Eller . | |
| 5,195,783 | 3/1993 | Lavoie . | |
| 5,242,055 | 9/1993 | Pora | 206/534 X |
| 5,364,133 | 11/1994 | Hofer et al. . | |
| 5,423,574 | 6/1995 | Forte-Pathroff . | |
| 5,482,163 | 1/1996 | Hoffman | 206/534 |

*Primary Examiner*—Jacob K. Ackun

[57] ABSTRACT

This invention pertains to an emergency medical dosage kit adapted to facilitate indication of the administration of emergency medication. The kit comprises (a) a predetermined amount of a medicine; and (b) a drug information sheet having detachably attached thereto a strip. The strip comprises (a) a long thin body having ends; (b) a device for forming a closed loop around the limb of a patient; and (c) a device, or region of the strip, used for indicating adminstration of a dosage of medicine. The strip is detached from the sheet of material and affixed to the limb of a patient to whom the medicine has been administered. The strip provides information to subsequent attending medical personnel as to the size, time and properties of the dosage of medicine administered. Such information ensures that subsequent attending medical personnel will be fully and accurately informed of treatment administered to the patient before the arrival of the patient into their care. In one embodiment, the invention provides a method of indicating a previously-given medical dosage to subsequent attending medical personnel.

21 Claims, 3 Drawing Sheets

METHOD AND APPARATUS FOR INDICATING A DOSAGE OF MEDICINE

FIELD OF THE INVENTION

This invention relates generally to the field of medicine, and more particularly to the field of emergency care procedures and products for patients in emergency medical situations.

BACKGROUND OF THE INVENTION

Personal emergency medical dosage kits generally contain a single dosage of a particular medicine, such as adrenaline, and an information sheet describing the characteristics of that medicine and/or the direction for its use. These kits may be used, for example, by emergency medical personnel such as paramedics or first-aiders. Such kits may also be carried by persons with known medical conditions which may require, under certain circumstances, the immediate administration of an emergency medication. Allergies to foods, such as peanuts or seafood, are examples of such conditions. Sufferers of diabetes also frequently carry medical dosage kits as well.

Typically, when a medical emergency arises, emergency medication will be self-administered by the person afflicted (hereinafter "patient"), administered by attending family or friends, or even by emergency medical personnel. The patient is then transported to hospital, often by someone other than the person who administered the medication to the patient. If this is the case, the amount and type of medication administered must be communicated to the person transporting the patient to hospital. In turn, the person transporting the patient to hospital would communicate the amount and type of medication administered to the subsequent attending medical personnel at the hospital.

Subsequent attending medical personnel, such as nurses or doctors in an emergency room, then receive the patient into their care. Typically, they will only receive the verbal communication of the person who transported the patient to hospital for their knowledge of the time, amount and type of the medication administered. The communication of these facts may be disrupted or ineffective. Subsequent attending medical personnel may not properly hear the information given by the person transporting the patient, or the information may be poorly or incorrectly communicated. In the case of a patient who administers medication to himself, such a patient may not be conscious by the time help arrives, and may be unable to communicate the time, amount and properties of the medication taken. In such a case, the subsequent attending medical personnel may have no information at all about the prior treatment.

Thus, there is a danger that attending medical personnel will be ignorant as to what medicine has been recently administered to a patient. Such information is vital in deciding how to proceed with treatment. Ignorance on the part of subsequent attending medical personnel of the medicine already administered to a patient can be very dangerous. If a doctor mistakenly assumes that such medication has already been given, he or she may fail to prescribe a life saving medication with dire consequences to the patient. If a doctor mistakenly assumes that no medication has been administered to a patient, then the doctor may prescribe an extra dose in addition to that already given, thus risking a harmful overdose to the patient.

In addition to the above-noted information, there are other types of information which may be important for subsequent treatment, and yet may not be properly communicated to subsequent attending medical personnel in an emergency situation. These include the patient's name, date of birth and medical diagnosis registry number.

Charts and bracelets are two methods commonly used for recording patient treatment information in hospitals. Charts are not appropriate for emergency situations occurring outside of hospitals, because they can easily become separated from the patient, resulting in an unacceptable loss of information. Furthermore, they are neither available nor appropriate for carrying around.

There are several different types of identification bracelets or devices in existence which can provide information about the medical condition of a patient. U.S. Pat. No. 4,914,843 and 4,783,917 both relate to bracelets which serve to identify a patient and can carry medical information. However, both of these devices are semi-permanent, and are not appropriate for emergency situations where they would have to be taken on and off without delay.

Other non-bracelet identification devices are also known, such as that disclosed in U.S. Pat. No. 4,863,195. However, this device also does not solve the problem of uncertain communication to medical personnel of recently administered emergency medication and patient information. Therefore, it is an object of this invention to provide a means for ensuring accurate communication to attending medical personnel of relevant patient information, as well as the time, amount and nature of any medication administered to a person, prior to such person arriving into the care of said attending medical personnel, particularly under emergency circumstances.

SUMMARY OF THE INVENTION

The emergency situation described above requires a device and method for effectively communicating to subsequent attending medical personnel the time, amount and type of emergency medication administered to a patient. Prior art devices used for conveying medical information are not appropriate for such an emergency situation because information cannot be easily and quickly added to such devices as circumstances change. Such devices do not provide an effective means for noting the administration of a drug in an emergency situation or for communicating necessary information to subsequent attending medical personnel.

What would be desirable is an invention which provides a medical dosage kit which allows a person administering a medication to ensure that subsequent attending medical personnel receive information about the administered medication. Preferably, such an invention would provide a convenient and certain method for communicating to subsequent medical personnel, the time, size and properties of a dosage of medication which has been administered to a patient. Such an invention should also be able to communicate to subsequent attending medical personnel the patient's name, date of birth and medical diagnosis registry number.

Accordingly, the present invention is directed to a medical dosage kit which is intended to be carried by either emergency medical workers, such as paramedics, first-aiders and ambulance drivers, or by persons who suffer medical conditions that may require emergency administration of a medication. Generally, the kit will contain a predetermined amount of the emergency drug constituting, for example, one dose. The kit also contains a drug information sheet, which contains information as to the properties, effects and/or directions for use of the drug.

In one aspect of the present invention, the sheet of material has a strip attached to it. This strip is easily detachable from the sheet of material. This strip is to be detached from the sheet by emergency medical personnel, or by any person administering a drug in an emergency. The strip includes means for forming a closed loop around the limb of a patient, ensuring that the information carried on the strip remains attached to the patient. The strip closure means can be one adhesive, two adhesives, mechanically interlockable ends, or any other method for forming a closed loop.

Preferably, the strip also provides means for indicating information regarding the patient and the dosage administered to the patient. These means can be a space for writing information about the patient, as well as time and amount of medicine given. Characteristics and information about the patient and the medication may be preprinted on the strip or symbolized by a electronically readable code.

BRIEF DESCRIPTION OF THE DRAWINGS

Reference will now be made, by way of example only, to figures of the invention, which illustrate preferred embodiments of the invention, and in which.

DETAILED DESCRIPTION OF THE PREFERRED EMBODIMENTS

Figure 1:
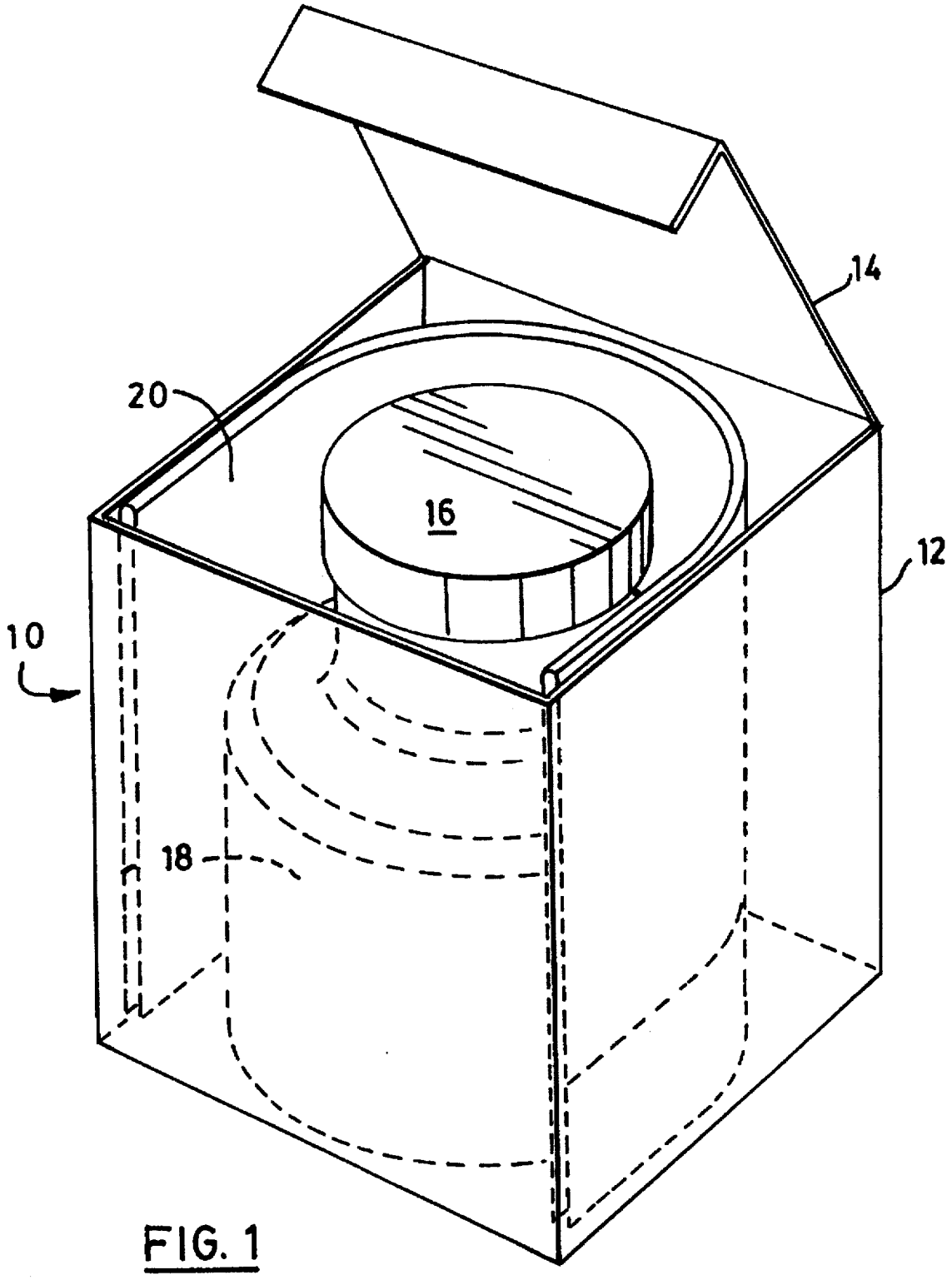
FIG. 1 depicts a medical dosage kit according to the present invention, before use.

FIG. 1 illustrates a medical dosage kit 10 according to the present invention, before use. The medical dosage kit 10 is made up of a box 12 with a lid 14. The box 12 contains a bottle or vial 16 which contains a predetermined amount of a medicine 18. The medicine 18 may be insulin, adrenaline, or any other medication which may need to be administered in an emergency. Also contained in the box 12 is a drug information sheet 20 folded and placed in the box 12. The drug information sheet 20 is a sheet of material having a description of the properties and preferred administration of a dosage of the medicine 18.

It will understood by those skilled in the art that the drug information sheet 20 need not be folded around the bottle 16, but may be inserted into the box 12 in any fashion. Alternatively, the invention may be practised with or without the box 12, where the drug information sheet 20 is attached to the bottle 16 by, for example, an adhesive or elastic. Generally, the drug information sheet 20 will be made from commercial grade paper. Commercial paper has the advantage of being easy to write on, but the disadvantage that it may also tear easily.

Figure 2:
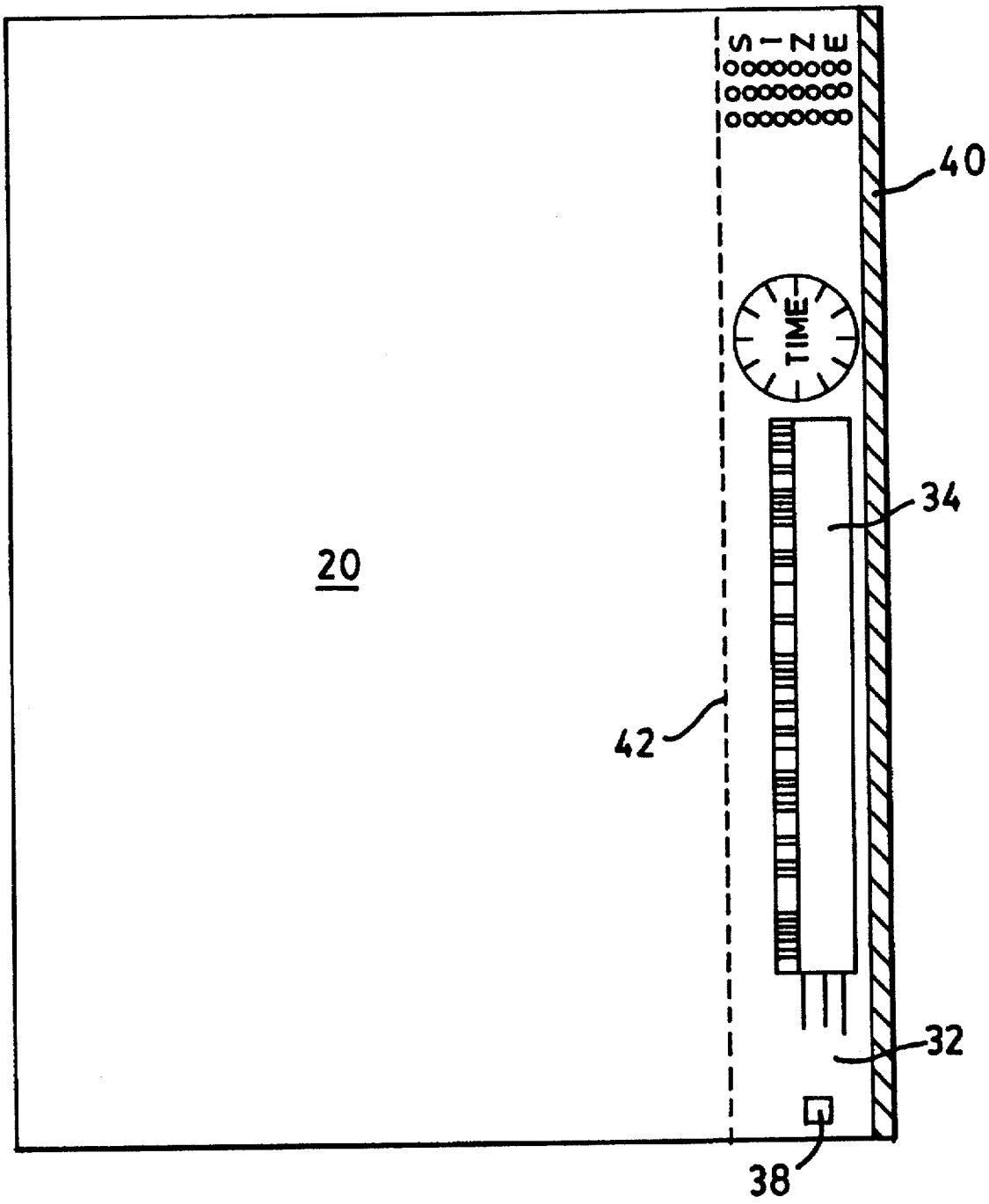
FIG. 2 depicts a drug information sheet as shown in FIG. 1, including an attached strip.

Referring now to FIG. 2, a strip 32 is shown detachably attached to the drug information sheet 20. In the preferred embodiment the strip 32 is detachably attached by a perforated edge 42 to the drug information sheet 20. To practice the invention, the strip 32 need not be connected by perforated edge to the drug information sheet 20. Any mode of attachment, such as a clip or adhesive, will suffice as long as the strip 32 is available at the time the kit is required. Alternatively, the strip 32 may be stored in the box 12 without being attached to the drug information sheet 20 at all.

On the surface of the strip 32 is a means for indicating administration of a dosage of medicine 34. In the preferred embodiment, the means for indicating administration of a dosage of medicine 34 will include a region of the strip 32 adapted for the recording of the time at which the dosage of medicine is administered, plus information about the patient, as described more fully below. As well, it will also include a region of the strip 32 bearing pre-recorded information as to the size of the dosage and/or as to the properties of the dosage.

The means for indicating administration of a dosage of medicine 34 may also include regions representing information about the time and size of dosage given. Holes could be punched in the appropriate regions of the strip 32, or alternatively pieces of material such as stickers could be affixed to said appropriate regions. The placement of said holes or stickers would indicate information about the dosage. For example, the clock face shown in FIG. 2 could be used to indicate time of dosage. The regions beside the title "size" can indicate digits of a number giving the size of an administered dosage.

At one end of the strip 32 is a means for forming a closed loop around a limb of a patient 38, which in this embodiment is in the form of a pressure-sensitive adhesive. It will be appreciated by those skilled in the art that a pressure-sensitive adhesive is any device or substance which causes two surfaces to be stuck together after the two surfaces are pushed up against one another. The means for forming a closed loop around a limb of a patient 38 need not be a pressure-sensitive adhesive, but may be any mechanism for easily and quickly forming a closed-loop around the limb of a patient, such as a clip.

It will be appreciated by those skilled in the art that human wrists vary in diameter from approximately four inches to approximately eleven inches. Therefore, in the most preferred form of the invention, the means for forming a closed loop around a limb of a patient 38 will allow for the varying of the size of the resulting loop. For example, when a pressure-sensitive adhesive is used, the adhesive located at one end of the strip 32 can be attached to any location along the strip 32 which would result in a loop fitting snugly over the wrist of the patient. If the patient has a large wrist, the adhesive would be applied so as to connect the two ends of strip 32 around the patient's wrist. If the patient has a very small wrist, the adhesive, located at one end of strip 32, would be used to attach that end to a point near the middle of the strip 32, thus forming a smaller loop. In the most preferred form, the strip has two dots of pressure-sensitive adhesive, one at each end, to allow both ends of the strip to be secured in a closed-loop. It will be appreciated by those skilled in the art that this same variable-sizing can be achieved with other means for forming a closed loop around a limb of a patient, such as a clip or other equivalent.

Along a side-edge of the strip 32 is a means for preventing tearing 40, which in this embodiment is in the form of a plastic laminate. The plastic laminate can be any plastic layer attached to the surface of the strip 32, but in the preferred embodiment must be sufficiently flexible to allow for easy bending of the strip 32. Furthermore, the invention can be practiced by replacing plastic laminate with any other means for preventing tearing. For example, while commercial grade paper is preferred for ease of printing, other grades of paper may also be used. If stronger paper is used, this may be sufficient to prevent tearing. As will be appreciated by those skilled in the art, what is desired is a wristband of sufficient strength and integrity that it will not tear and fall off unexpectedly, but not so strong or wellfastened that it cannot be readily removed by subsequent medical personnel.

Figure 3:
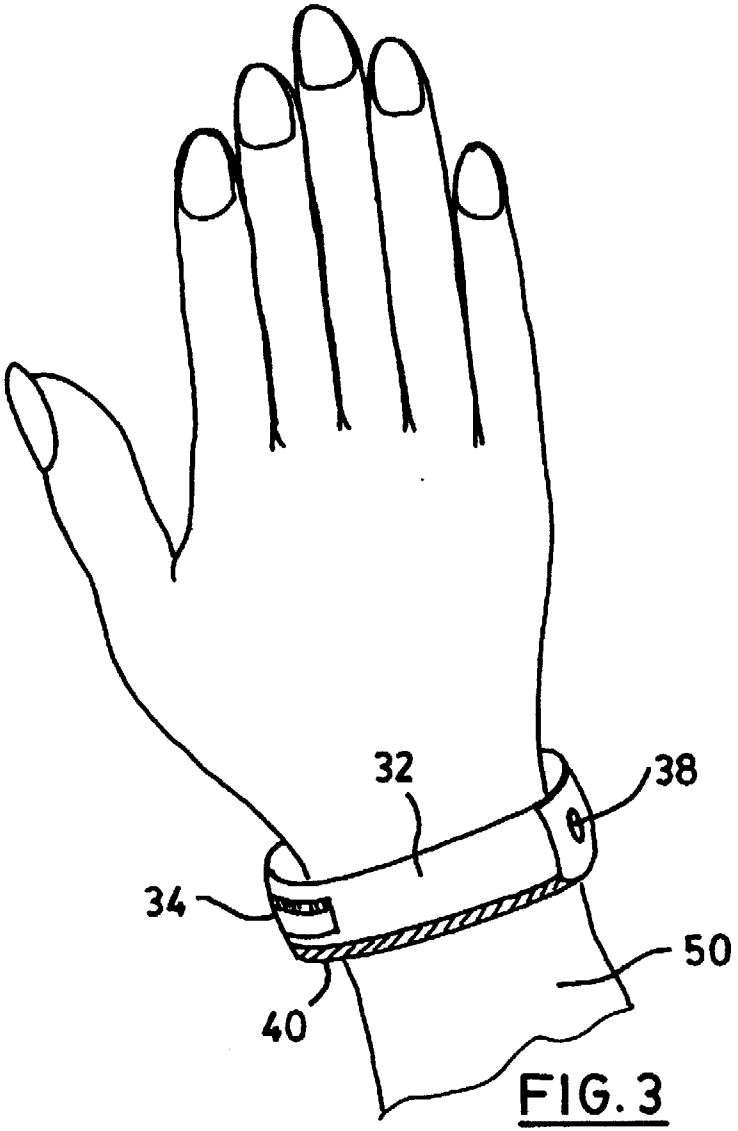
FIG. 3 depicts the strip of FIG. 2, detached from the sheet and affixed to an arm.

FIG. 3 depicts a patient's arm 50. The strip 32 is shown affixed to the wrist of a patient by the operation of the means for forming a closed loop around a limb of a patient 38. The means for indicating administration of a dosage of medicine 34 is highly visible, and will be easily seen by subsequent attending medical personnel. Along a side-edge of the strip 32 is the means for preventing tearing 40, which serves to prevent unwanted tearing of strip 32 as discussed above.

Figure 4:
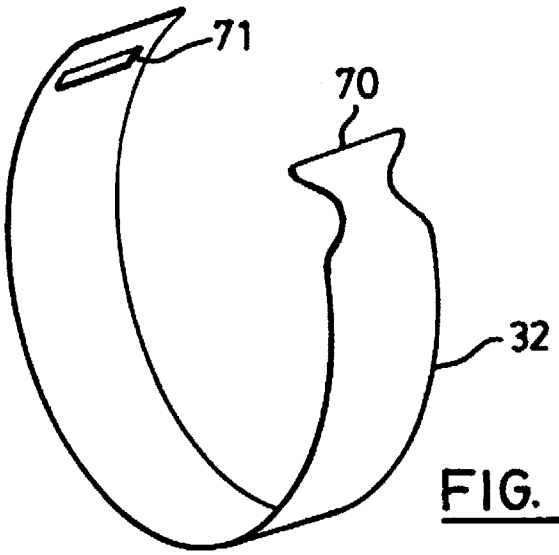
FIG. 4 depicts a second embodiment of the invention.

FIG. 4 depicts another embodiment of the invention wherein the strip 32 has mechanically interlockable ends 70 and 71 which can be used to affix the strip 32 to the patient's arm 50, instead of the pressure-sensitive adhesive. It will be appreciated by those skilled in the art that many different forms of mechanical and adhesive attachments may be used, all of which will function, provided that a closed loop may be readily and easily formed. In this regard, the pressure-sensitive adhesive is preferred, as the loop will often be formed by the patient himself. Use of pressure-sensitive adhesives facilitates one-handed loop formation.

Figure 5:
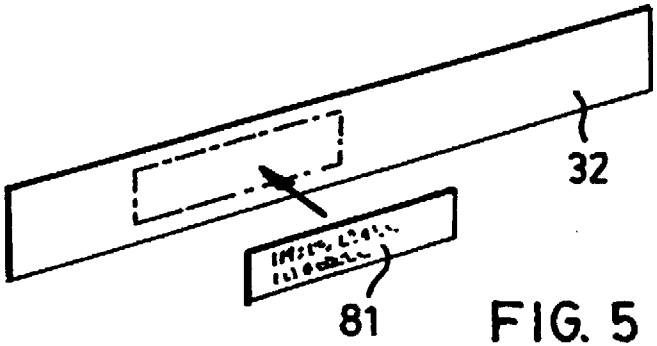
FIG. 5 depicts a third embodiment of the invention.

FIG. 5 depicts another embodiment of the invention wherein the invention includes a piece of material 81 having indicated thereon information related to an administered dosage of medicine. The piece of material 81 can be affixed to a region of the strip 32 to indicate the administration of a dosage of medicine, and to convey information about said dosage. The piece of material 81 may be attached by an adhesive, or by any other means, such as a clip.

It can now be appreciated how the present invention may be used. A person administering medicine in a medical emergency removes the bottle 16 and the drug information sheet 20 from the box 12. The predetermined amount of medicine 18 is administered (or self-administered) to the patient. The person administering the medication would then use the means for indicating administration of a dosage of medicine 34 for indicating on the strip 32 information relating to the dosage. Said means could also be used to indicate other relevant information, such as the patient's name, date of birth and medical diagnosis registry number. The person administering the medication may be a emergency medical worker such as an ambulance attendant, first-aider or paramedic. Alternatively, the person administering the medication may be a bystander or even the patient himself.

The step of indicating on the strip 32 information relating to the dosage may be taken in many different ways. For example, this step may be executed by punching a hole in or affixing a piece of material to a specific region of the strip 32, said region representing specific information relating to said dosage, such as a time, amount or other aspect. Alternatively, this step may comprise affixing to the strip 32 a piece of material (FIG. 5) having indicated thereon information relating to the time, amount or other aspect of the dosage. Said piece of material may be a sticker, or any other material, and may be affixed to the strip 32 by means of an adhesive, or any other means of attachment.

In the preferred embodiment, the step of indicating on the strip 32 information relating to the dosage will be executed by writing on the strip 32 said information relating to the dosage. Most preferably the indicating step will only require that variable information be entered. In this sense, variable information would be information specific to the patient such as time the dose was administered, and if not a set amount, the specific amount of the dose. Constant information, which may be considered as information which does not vary with the patient, can be preprinted on the strip, as noted above. Constant information would be the precise medicine that was administered together with some information about its properties or even compatibility with other medicines.

The person administering the medication would then detach the strip 32 from the drug information sheet 20, and affix the strip 32 to the patient's arm 50. In the preferred embodiment, this would be done by pressing the two ends of the strip 32 together, thus activating the pressure-sensitive adhesive, and forming a closed loop around the patient's limb.

Subsequent attending medical personnel can then use the strip 32 affixed to the patient's arm 50 to obtain precise information as to the time, dosage and properties of the medication that was administered to the patient. As soon as further treatment is to be administered, the strip 32 is removed from the patient's arm 50 to ensure that the strip 32 does not incompletely or inaccurately communicate the last treatment given to the patient. Alternatively, once the medical chart is started, the information on the wristband or strip 32 can be transferred onto the chart and then the strip 32 removed by the attending physician.

It will be apparent to those skilled in the art that various adaptions and variations are possible without departing from the broad scope of this invention, as defined in the appended claims. Some of these variations have been discussed above and others will be apparent to those skilled in the art. For example, the precise means of forming a closed loop can vary, as can the manner in which the dosage information is indicated. However, what is important to the present invention is to provide an easy-to-use, reliable and accurate indicator of prior treatments by what may likely be non-medical personnel, to subsequent attending physicians.

I claim:

1. A medical dosage kit comprising:

a predetermined amount of a medicine; and a sheet of material having a description of the properties and preferred administration of a dosage of said medicine and having detachably attached thereto a strip, said strip comprising:

a long, thin body having ends;

means for forming a closed loop around a limb of a patient between said ends; and means for indicating administration of a dosage of said medicine to said patient;

whereby the strip is detached from the sheet of material and affixed to the limb of a patient to whom said medicine has been administered, and provides information to subsequent attending medical personnel as to the time, size of dosage or properties of the administered medicine, to facilitate continuity of treatment of said patient.

2. A medical dosage kit as claimed in claim 1 wherein said strip further includes a means for preventing tearing.

3. A medical dosage kit as claimed in claim 2 wherein said means for preventing tearing is a plastic laminate.

4. A medical dosage kit as claimed in claim 2 wherein said means for preventing tearing is a plastic laminate located along a side-edge of said strip.

5. A medical dosage kit as claimed in claim 1 wherein said predetermined amount of medicine is contained in a bottle and said sheet of material is attached to said bottle.

6. A medical dosage kit as claimed in claim 1 wherein said strip further includes a perforated edge, and said strip is detachably attached to said sheet of material by said perforated edge.

7. A medical dosage kit as claimed in claim 1 wherein said means for forming a closed loop around a limb of a patient comprises a pressure-sensitive adhesive.

8. A medical dosage kit as claimed in claim 1 wherein said means for forming a closed loop around a limb of a patient comprises opposed mechanically interlockable ends.

9. A medical dosage kit as claimed in claim 1 wherein said means for indicating administration of a dosage of said medicine comprises a region of said strip bearing pre-recorded information as to the size of said dosage and as to the properties of said dosage.

10. A medical dosage kit as claimed in claim 1 wherein said strip is adapted to record the time at which said dosage is administered.

11. A medical dosage kit as claimed in claim 1, wherein said strip is detachably attached to said sheet of material by a perforated edge, said strip comprising a means for forming a closed loop around a limb of a patient between said ends, wherein said means for forming a closed loop around a limb of a patient between said ends comprises a pressure-sensitive adhesive.

12. A medical dosage kit as claimed in claim 1 wherein:

said strip further includes a perforated edge and said strip is detachably attached to said sheet of material by said perforated edge;

said strip comprises a means for preventing tearing;

said means for preventing tearing comprises a plastic laminate located along a side edge of said strip; and wherein said means for forming a closed loop around a limb of a patient between said ends comprises a pressure-sensitive adhesive.

13. A medical dosage kit as claimed in claim 1 wherein said strip comprises:

a means for preventing tearing; and wherein said means for indicating administration of a dosage of said medicine to said patient comprises a region of said strip bearing pre-recorded information as to the size of said dosage and as to the properties of said dosage, and said strip being adapted to record the time at which said dosage is administered.

14. A medical dosage kit as claimed in claim 1, wherein said means for forming a closed loop around a limb of a patient between said ends comprises a pressure-sensitive adhesive; and wherein said means for indicating administration of a dosage of said medicine to said patient comprises a region of said strip bearing pre-recorded information as to the size of said dosage and as to the properties of said dosage, and said strip adapted to record the time at which said dosage is administered.

15. A medical dosage kit as claimed in claim 1, wherein:

said strip further includes a perforated edge and said strip is detachably attached to said sheet of material by said perforated edge;

said strip further comprises a means for preventing tearing, said means for preventing tearing comprising a plastic laminate located along a side-edge of said strip.

16. A medical dosage kit as claimed in claim 1, said strip comprising:

a means for preventing tearing;

wherein said means for forming a closed loop around a limb of a patient between said ends comprises a pressure-sensitive adhesive; and wherein said means for indicating administration of a dosage of said medicine to said patient comprises a region of said strip bearing pre-recorded information as to the size of said dosage and as to the properties of said dosage, and said strip being adapted to record the time at which said dosage is administered.

17. A medical dosage kit comprising:

a predetermined amount of a medicine;

a sheet of material having a description of the properties and preferred administration of a dosage of said medicine; and a strip, said strip comprising:

a long, thin body having ends;

means for forming a closed loop around a limb of a patient between said ends; and means for indicating administration of a dosage of said medicine to said patient;

whereby the strip is affixed to the limb of a patient to whom said medicine has been administered, and provides information to subsequent attending medical personnel as to the time, size of dosage or properties of the administered medicine, to facilitate continuity of treatment of said patient.

18. A method of indicating a dosage of medicine which has been administered to a patient comprising the following steps:

(a) removing from a medical dosage kit a sheet of material having a description of the properties and preferred administration of a dosage of said medicine and having detachably attached thereto a strip, said strip comprising a long, thin body having ends, means for forming a closed loop around a limb of a patient between said ends and means for indicating administration of a dosage of said medicine to said patient;

(b) indicating on said strip information relating to said dosage;

(c) detaching said strip from said sheet of material; and (d) affixing said strip around a limb of said patient;

whereby said strip, having been affixed to the limb of a patient to whom said medicine has been administered, provides information to subsequent attending medical personnel as to the time, size of dosage or properties of the administered medicine, and facilitates continuity of treatment of said patient.

19. The method as claimed in claim 18 wherein the step of indicating on said strip information relating to said dosage comprises punching a hole in a specific region of said strip, said region representing specific information relating to said dosage.

20. The method as claimed in claim 18 wherein the step of indicating on said strip information relating to said dosage comprises writing on said strip information relating to said dosage.

21. The method as claimed in claim 18 wherein the step of indicating on said strip information relating to said dosage comprises affixing to said strip a piece of material having indicated thereon information relating to said dosage.

* * * * *